US008109839B2

(12) United States Patent
Jones et al.

(10) Patent No.: US 8,109,839 B2
(45) Date of Patent: Feb. 7, 2012

(54) GOLF SWING TRAINING DEVICE AND METHOD

(75) Inventors: Frederick E. Jones, Grand Rapids, MI (US); Wilfred L. Vasel, Grand Rapids, MI (US)

(73) Assignee: TWW Enterprise LLC, Grand Rapids, MI (US)

( * ) Notice: Subject to any disclaimer, the term of this patent is extended or adjusted under 35 U.S.C. 154(b) by 135 days.

(21) Appl. No.: 12/604,013

(22) Filed: Oct. 22, 2009

(65) Prior Publication Data

US 2011/0098125 A1 Apr. 28, 2011

(51) Int. Cl.
*A63B 69/36* (2006.01)

(52) U.S. Cl. ..... 473/269; 473/270

(58) Field of Classification Search ..... 473/266, 473/269, 270, 273, 278, 279; 446/26, 415, 446/418

See application file for complete search history.

(56) References Cited

U.S. PATENT DOCUMENTS 186,169 A * 1/1877 Rowbotham ..... 446/415
2,223,668 A * 12/1940 Nicola ..... 84/484
4,037,847 A 7/1977 Lorang
4,073,075 A 2/1978 O'Brien
4,106,771 A 8/1978 Fern
4,118,034 A 10/1978 O'Brien
4,917,385 A 4/1990 Brown
5,000,457 A 3/1991 Brown
5,487,546 A 1/1996 Yasuda
5,564,989 A 10/1996 Larsen
5,916,036 A * 6/1999 Hamilton ..... 473/269
7,018,301 B1 3/2006 Cascerceri et al.
7,112,144 B2 9/2006 Mindlin
2002/0032072 A1 3/2002 Sladek
2006/0019763 A1 1/2006 Anderson
2006/0046864 A1 3/2006 Pagano
2007/0142119 A1 6/2007 Popin

* cited by examiner

*Primary Examiner* — Nini Legesse
(74) *Attorney, Agent, or Firm* — Price Heneveld LLP

(57) ABSTRACT

A golf swing aid apparatus includes a base forming a sound chamber, a cover pivoted to the base, and a noisemaker configured to actuate a clicker in the base when the cover is released. The present apparatus provides a click noise immediately prior to ball impact during a golfer's swing, thus providing feedback on synchronized timing of the swing. The feedback is real time, and is of a nature whereby a golfer can recognize its feedback without disrupting the golf swing itself. The apparatus can be anchored using golf ball tees, and an accessory used that helps alignment of the golfer's stance. Notably, the present apparatus can be used in a variety of sports with a swing where weight transfer is important, such as softball and baseball.

17 Claims, 4 Drawing Sheets

GOLF SWING TRAINING DEVICE AND METHOD

BACKGROUND

The present invention relates to golf swing training devices.

Golf swings are one of the simplest yet most complex athletic movements in sports. Golfers spend hours practicing their swings, trying to refine them to perfection, so that golf shots can be accurately repeated. Fundamentally, good golf swings include a coordinated leg/body/arm/wrist rotation and movement, including weight transfer, timed to provide a controlled speed and power transfer to a golf club head. There are several difficulties in trying to optimize a golf swing. One problem is that golfers (new and experienced) can't get real-time feedback on the timing of their leg/body/arm/wrist rotation and movement. Another problem is that novice (and experienced) golfers don't have a feel for when the leg and body turn should occur during a golf swing. Still another problem is that it is amazingly difficult to both perform a golf swing and also pay attention to what is being done wrong.

SUMMARY OF THE PRESENT INVENTION

In one aspect of the present invention, a swing aid apparatus includes a base forming a sound chamber configured to reflect sound upwardly, a cover movably supported on the base and configured to matably receive a foot, a noisemaker positioned in the sound chamber and configured to generate a sound when released, and an actuating member extending from the cover and causing the noisemaker to generate sound when the cover moves due to the foot moving during a swing, thus providing feedback on timing of the swing relative to movement of the foot.

In another aspect of the present invention, a golf swing aid apparatus comprises a chamber including a noise-making clicker configured to reflect sound upwardly, and a cover shaped to be temporarily depressed by a golfer's foot and movably supported over the clicker; the cover including an actuating member for causing the clicker to generate a sound when released; thus providing feedback on timing of the swing relative to movement of the foot.

In another aspect of the present invention, a golf swing aid apparatus includes a base, a cover movably supported on the base for movement between a depressed position when depressed under a golfer's foot and a released position, a noisemaker on one of the base and cover that is configured to generate a sound when released, and an actuating member on the other of the base and cover for causing the noisemaker to generate sound when the cover moves to the released position.

In another aspect of the present invention, a golf swing aid apparatus includes a base and cover configured to matably receive a golfer's foot and configured to generate a sound when the cover moves from a foot-depressed position to a foot-released position; the base including at least two holes opening downwardly, and golf ball tees extending through the at least two holes and adapted to anchor the base on the ground surface.

In yet another aspect of the present invention, a golf swing aid apparatus includes a base and cover configured to matably receive and engage a golfer's first foot and configured to generate a sound when the cover moves from a foot-depressed position to a foot-released position, and an alignment accessory attached to base and having a cord for extending from the base, the cord having a length and being configured to assist with placement and alignment of a second foot of the golfer.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
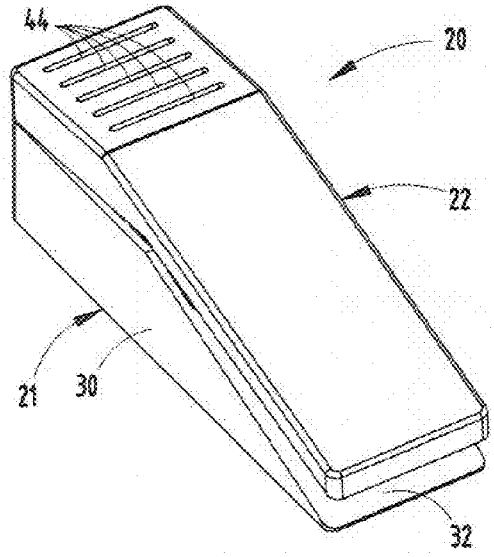
FIGS. 1-2 are front and rear perspective views of an apparatus embodying the present invention.
Figure 2:
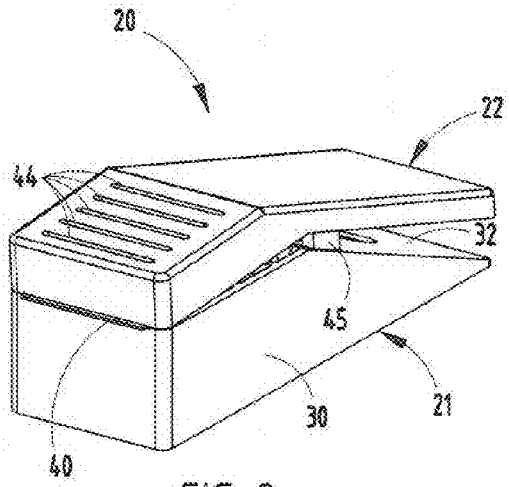
Figure 3:
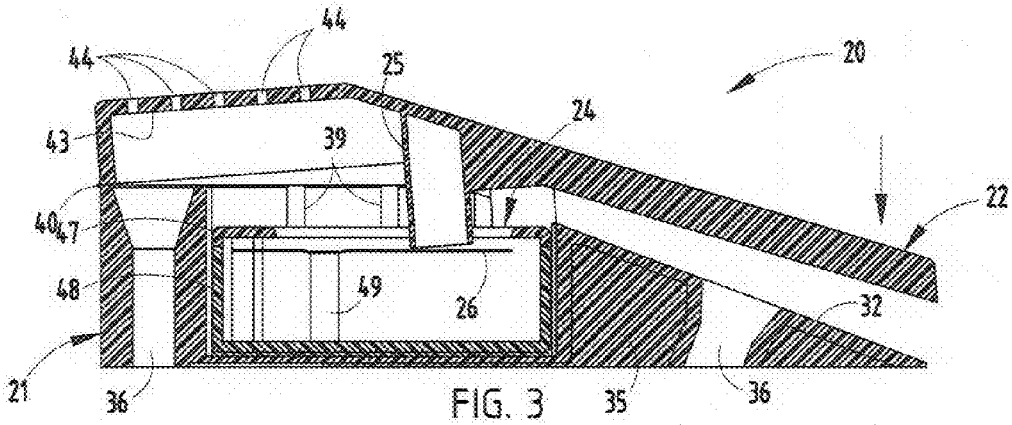
FIGS. 3-4 are side cross-sectional views showing un-depressed and depressed positions of the apparatus of FIG. 1.
Figure 4:
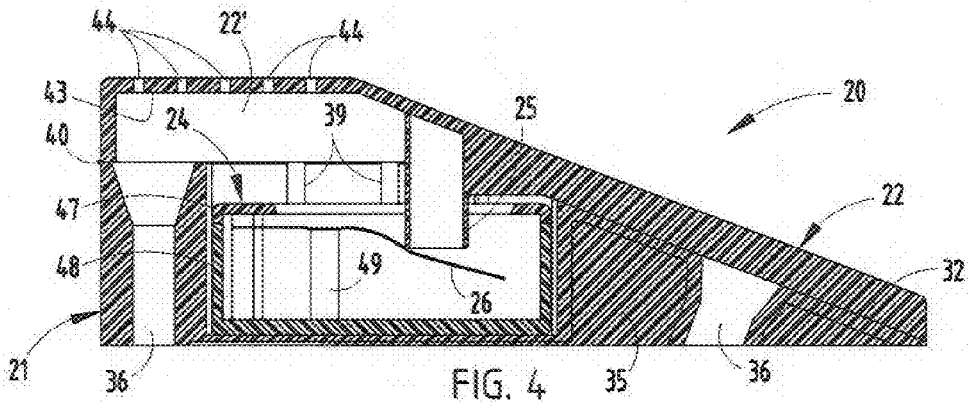
Figure 5:
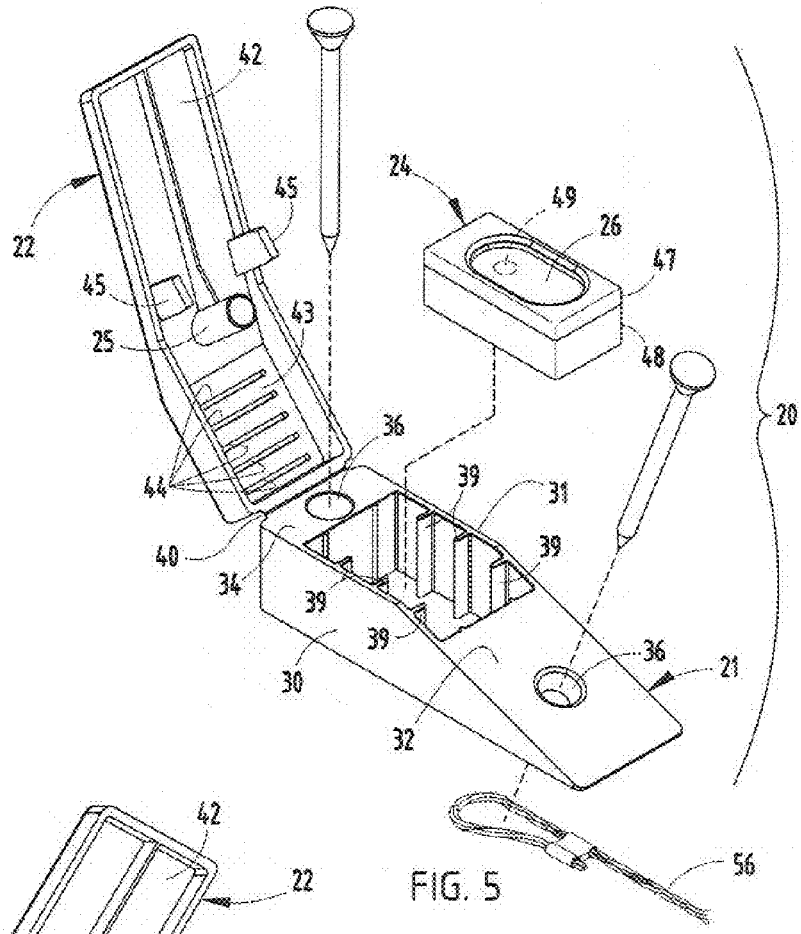
FIG. 5 is a perspective exploded view showing the apparatus of FIG. 1 opened and with its noise-maker clicker subassembly exploded away.

A golf swing aid apparatus 20 (FIGS. 1-2) includes a base 21 forming a sound chamber 22' configured to reflect sound upwardly, a cover 22 movably supported on the base 21 and configured to matably receive a golfer's foot 23 (FIGS. 9-10), a noisemaker 24 (also called "clicker subassembly") (FIGS. 1-2) positioned in the sound chamber 22' (FIG. 4) and configured to generate a sound when released, and an actuating member 25 (FIGS. 3-5) extending from the cover 22 into engagement with the clicker 26 of the noisemaker 24 to generate sound when the cover 22 moves due to the foot 23 (FIGS. 9-10) moving/lifting during a golf swing. The present apparatus 20 provides a click noise immediately prior to ball impact, thus providing feedback on the synchronized timing of leg/body/hip/arm/wrist movement and weight transfer, including movement of a golfer's foot, during a golf swing. The feedback is real time, and is of a nature whereby a golfer can recognize its feedback without disrupting the golf swing itself. Further, a triangular shape of the apparatus 20 causes the golfer's foot to cant and knee to bend slightly, leading to a better turn (i.e., less "sway").

Figure 6:
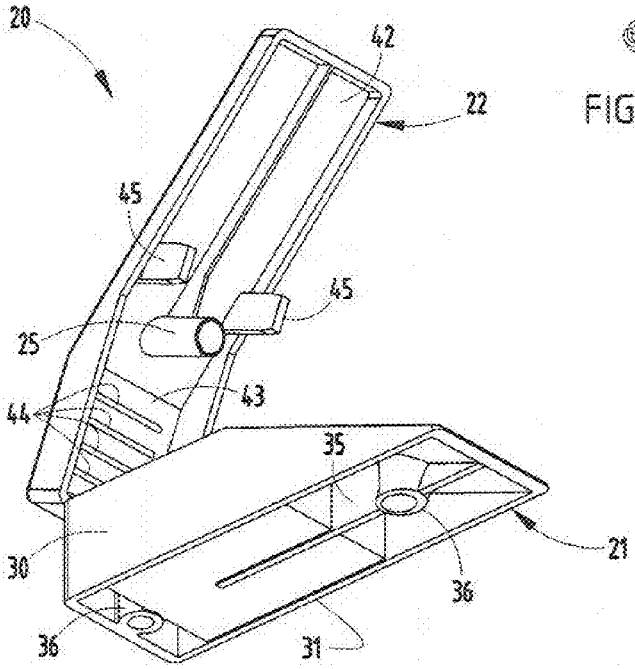
FIGS. 6-7 are perspective views of the base, cover and clicker subassembly, with the cover being in an open position.
Figure 7:
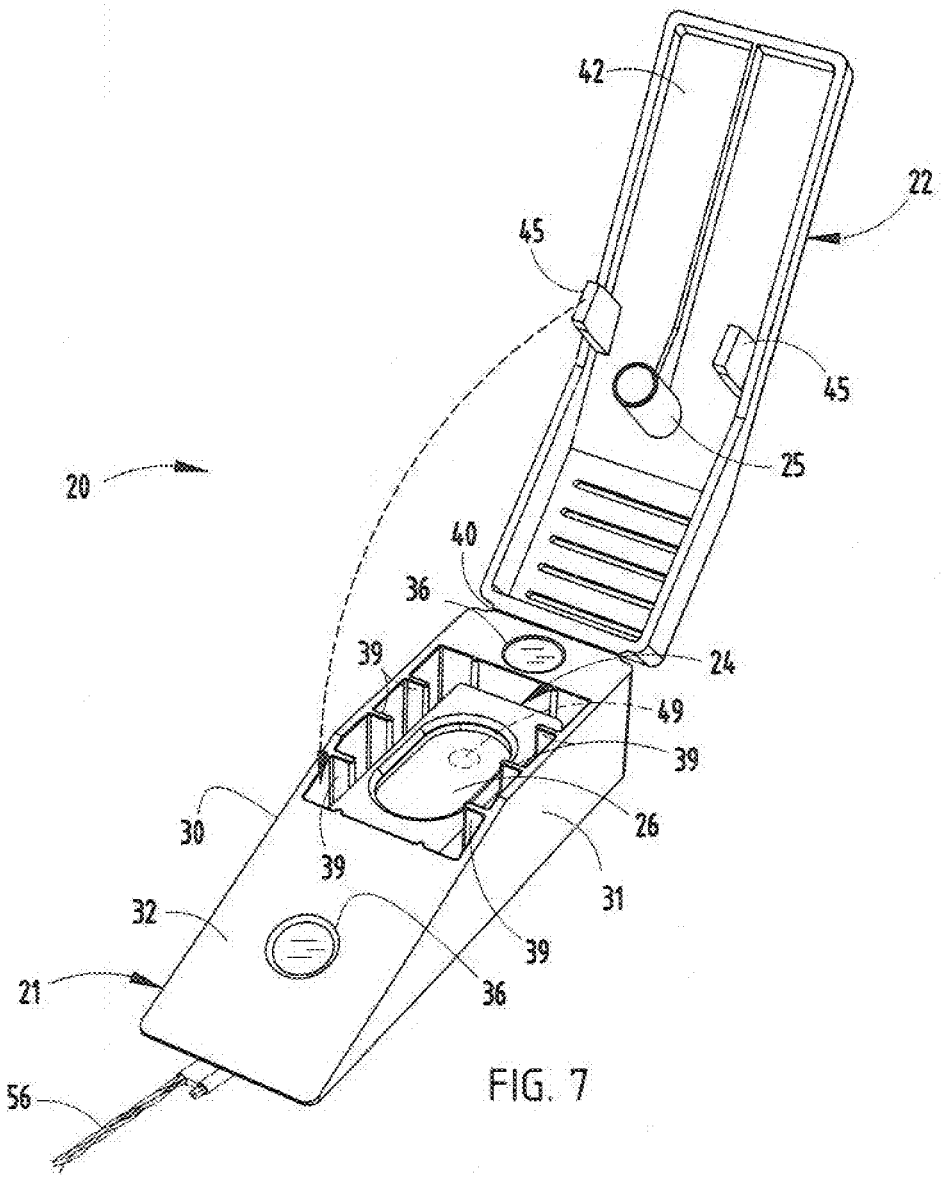
Figure 8:
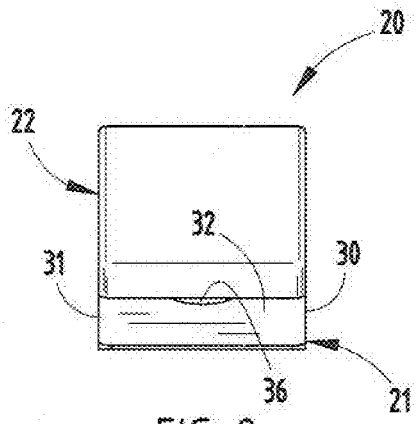
FIG. 8 is an end view of the apparatus of FIG. 1.

The base 21 (FIG. 5) includes side walls 30 and 31, angled top wall 32, short horizontal top wall 34, rear wall unlabeled, longitudinal bottom rib 35 (FIG. 6) and aperture bosses 36, as well as side-wall-stiffening ribs 39 forming a pocket inside of the base 21. The pocket forms a sound chamber, but also the clicker subassembly 24 forms a sound chamber as discussed below.

Figure 9:
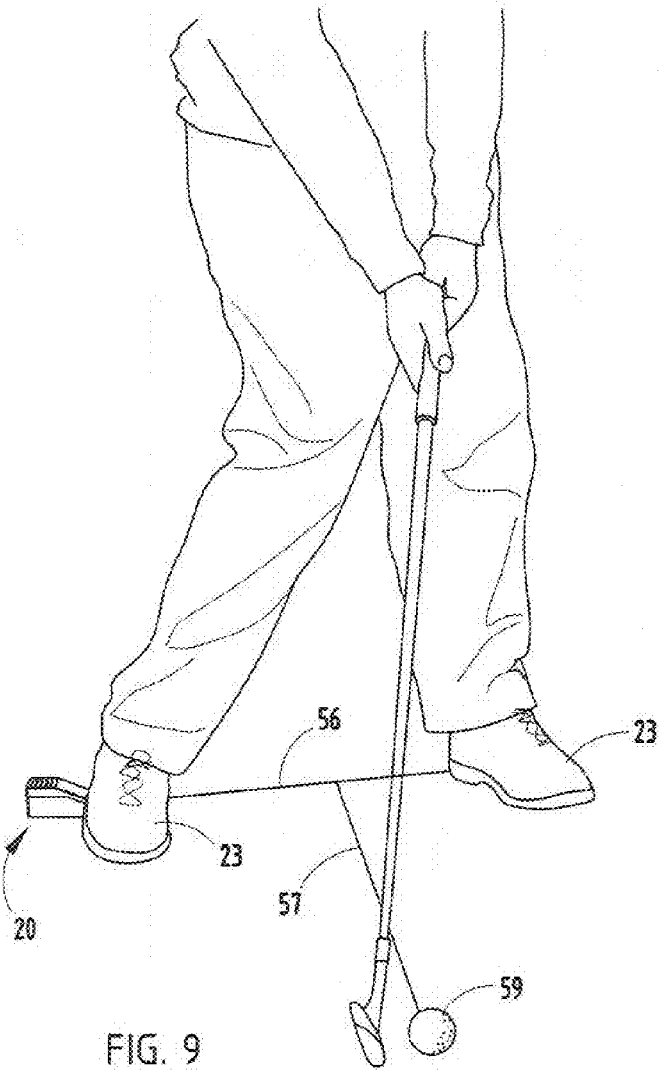
FIG. 9 is a perspective view showing use of the present apparatus during a golf swing.
Figure 10:
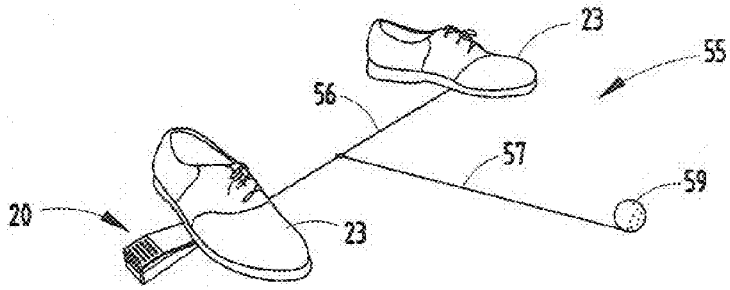
FIG. 10 is a perspective view showing use of the alignment accessory with the present apparatus.

The cover 22 (FIGS. 5-6) is movably supported on the base 21 and configured to matably receive a golfer's foot 23 (FIGS. 9-10). As illustrated, the cover 22 is integrally molded as a single molding with the base 21, and further is made without slides or pulls in the molding dies, such that cost is reduced substantially. The cover 22 and base 21 are connected by a living hinge 40, which allows the cover 22 to pivot from the as-molded "open" position shown in FIG. 5 to the closed "assembled" position shown in FIGS. 1-2. The cover 22 includes top angled wall 42, top horizontal wall 43 with slots 44 (also called openings) for allowing sound to pass upwardly, perimeter rib 45 extending around walls 42-43 for stiffening, a boss forming the actuator 25, and guidance tabs 45.

The clicker subassembly 24 (FIG. 5) is positioned in the sound chamber of the base 21 and includes top and bottom housing members 47 and 48 which clamping hold a sheet of metal forming the clicker 26. The sheet of metal (i.e. clicker 26) is relatively flat when not depressed, includes a fixed end held by the members 47/48 and a free end, and includes an embossment 49 at its bend point. The boss actuator 25 is positioned to engage the free end when the cover 22 is depressed by a golfer's foot. When the foot is lifted, the clicker 26 has sufficient force and resiliency such that the clicker 26 lifts the cover 22 and also creates a "click" noise due to the flexing movement of the sheet of metal. Notably, there are a variety of clicker subassemblies that are commercially available, and also such devices are publically known, such as for training dogs.

When depressed, the clicker 26 creates a "click" noise indicating to the golfer that the aid is set and ready. When the golfer swings, there is a natural movement of the golfer's body and weight transfer, such that the foot is lifted. As noted above, when the foot is lifted, the clicker 26 has sufficient force and resiliency to lift the cover 22 and also create a "click" noise due to the flexing movement of the sheet of metal. This click noise should occur at a specific time immediately prior to the golfer's club against a golf ball. If the noise occurs too soon or too late, the golfer knows that the swing is not optimized. Notably, this sound is sufficient so that it can be easily heard and reacted to, yet it does not tend to disrupt the golf swing, and further the golfer can concentrate on his swing rather than the teaching aid.

An alignment accessory 55 (FIG. 10) is provided comprising two cords interconnected to form Y shape. The first cord 56 connects to the apparatus 20 and extends to a second foot of the golfer, so as to indicate a best distance/spacing and also a direction of the golfer's stance. The second cord 57 includes a first end loop that connects to the first cord 56, and a second end that extends to approximate a position of a golf ball 59 relative to the stance. The first cord 56 is preferably about 24" long, and the second cord 57 is about 18" long. For example, a gold professional can position the second cord 57 on the first cord 56 to show a novice golfer a proper ball position relative to the golfer's feet for different golf clubs, such as a driver, a long iron, a short iron, etc.

It is to be understood that variations and modifications can be made on the aforementioned structure without departing from the concepts of the present invention, and further it is to be understood that such concepts are intended to be covered by the following claims unless these claims by their language expressly state otherwise. For example, it is contemplated that a scope of the present invention includes substituting an electronic noisemaker in place of the mechanical noisemaker 24.

It is also contemplated that the present apparatus can be used in any sport where weight transfer as part of an athletic movement (i.e., swing) is important, such as baseball or softball.

The embodiments of the invention in which an exclusive property or privilege is claimed are defined as follows:

1. A swing aid apparatus comprising:

a base forming a sound chamber configured to reflect sound upwardly;

a cover movably supported on the base and configured to matably receive a foot;

a noisemaker positioned in the sound chamber and configured to generate a sound when released; and an actuating member extending from the cover and causing the noisemaker to generate sound when the cover moves due to the foot moving during a swing, thus providing feedback on timing of the swing relative to movement of the foot, wherein the base and cover are interconnected by a living hinge.

2. The apparatus defined in claim 1, wherein the cover forms a downward-facing concavity but includes openings for sound passage upwardly.

3. The swing aid apparatus defined in claim 1, wherein the base and cover are molded as a one-piece molding.

4. The apparatus defined in claim 1, wherein the actuating member includes a protrusion extending from the cover.

5. The apparatus defined in claim 1, wherein the noisemaker is a separate unit set into the sound chamber, the noisemaker including a sub-housing and a metal sheet that generates a clicking noise when bent or released from a bent condition.

6. The apparatus defined in claim 5, wherein the metal sheet includes an embossment that creates a clicker noise when bent by the actuating member.

7. The apparatus defined in claim 5, wherein the actuating member abuts a free end of the sheet and bends and unbends the sheet to cause noise upon both pressure and release on the cover from the foot.

8. The apparatus defined in claim 1, wherein the cover includes openings for release of sound.

9. The apparatus defined in claim 1, wherein the cover is hinged to the base.

10. The apparatus defined in claim 1, wherein the base includes a top surface with a horizontal portion and an angled portion, the angled portion having a height and shape configured to fit generally under an arch of the foot.

11. The apparatus defined in claim 10, wherein the cover includes a bottom surface that generally matches and mates with the horizontal portion and the angled portion.

12. The apparatus defined in claim 1, wherein the base includes openings for receiving ground-engaging tie-downs.

13. The apparatus defined in claim 12, wherein the openings include at least two openings sized for using golf ball tees.

14. A swing aid apparatus comprising:

a base forming a sound chamber configured to reflect sound upwardly;

a cover movably supported on the base and configured to matably receive a foot;

a noisemaker positioned in the sound chamber and configured to generate a sound when released;

an actuating member extending from the cover and causing the noisemaker to generate sound when the cover moves due to the foot moving during a swing, thus providing feedback on timing of the swing relative to movement of the foot; and an alignment accessory attached to the base and having a first cord for extending between the base and a second foot of a golfer.

15. The apparatus defined in claim 14, wherein the accessory also has a second cord slidably engaging the first cord and forming a Y shape therewith, the second cord's length being sufficient to assist in aligning a golf ball position with a stance of the golfer when the first cord is aligned with the golfer's stance.

16. A golf swing aid apparatus comprising:

a base and cover configured to matably receive and engage a golfer's first foot and configured to generate a sound when the cover moves from a foot-depressed position to a foot-released position; and an alignment accessory attached to the base and having at least one cord for extending from the base, the cord having a length and being configured to assist with placement and alignment of a second foot of the golfer, wherein the at least one cord includes a first cord and a second cord slidably engaging the first cord, the second cord extending therefrom to assist with ball position.

17. The apparatus defined in claim 16, wherein at least one of the first and second cords has a length of at least about 24 inches.

* * * * *